US006234415B1

(12) United States Patent
Liin

(10) Patent No.: US 6,234,415 B1
(45) Date of Patent: May 22, 2001

(54) PULPING APPARATUS

(75) Inventor: Sven Liin, Kungsängen (SE)

(73) Assignee: Cellwood Machinery AB, Nassjo (CH)

( * ) Notice: Subject to any disclaimer, the term of this patent is extended or adjusted under 35 U.S.C. 154(b) by 0 days.

(21) Appl. No.: 09/403,832

(22) PCT Filed: Apr. 24, 1998

(86) PCT No.: PCT/SE98/00756

§ 371 Date: Dec. 7, 1999

§ 102(e) Date: Dec. 7, 1999

(87) PCT Pub. No.: WO98/49389

PCT Pub. Date: Nov. 5, 1998

(30) Foreign Application Priority Data

Apr. 29, 1997 (SE) ..... 9701606

(51) Int. Cl.[7] ..... B02C 23/36

(52) U.S. Cl. ..... 241/46.11; 241/46.17; 241/69

(58) Field of Search ..... 241/69, 46.11, 241/46.17

(56) References Cited

U.S. PATENT DOCUMENTS 3,163,368 * 12/1964 Johnson ..... 241/46.17
4,535,943 * 8/1985 Couture ..... 241/46.17
4,607,802 8/1986 Lamort .

FOREIGN PATENT DOCUMENTS 3149135 6/1983 (DE) .
117 716 9/1984 (EP) .
2 113 570 8/1983 (GB) .
189 584 5/1964 (SE) .

* cited by examiner

*Primary Examiner*—Mark Rosenbaum
(74) *Attorney, Agent, or Firm*—Sughrue, Mion, Zinn, Macpeak & Seas, PLLC

(57) ABSTRACT

A pulper includes a rotor (5) mounted in a tube adjacent to a screening plate (4) having holes (4*a*). The rotor (5) includes helical vanes (5*a*) whose diameter decreases towards the outer end of the rotor. The rotor vanes (5*a*) carry in the vicinity of the screening plate a radially and outwardly projecting shoulder-like element (10) having a leading surface (10*b*) which is generally flat and inclined relative to the screening plate (4) at an angle of 55°–85°, and a trailing part having a reversed wing-profile shape as seen in the direction of rotation. The element forms a pressure-generating and subpressure-generating device which exerts an alternating effect on the pulp as the rotor rotates, therewith counteracting clogging of the holes (4*a*) in the screening plate. The shoulder-like element (10) may comprise a completely or partially separate element in relation to the rotor, and may be detachable therefrom and replaceable, and also optionally reversible.

10 Claims, 2 Drawing Sheets

PULPING APPARATUS

FIELD OF INVENTION

The present invention relates to a pulping apparatus.

Such pulping apparatus that include a rotor which is mounted adjacent to a perforated screening plate and which includes helical blades or vanes and whose outer end decreases in diameter are adapted to operate at high pulp concentrations and low apparatus power inputs. In the case of known pulping apparatus, the consistency of the pulps may vary between 3–10% or more, depending on the material concerned and also depending on whether the pulping apparatus operates continuously or batch-wise.

Paper and pulp stock are essentially pulped by the internal friction generated in the pulp flow at high concentrations. It is therefore essential to provide effective circulation even at high concentrations.

The spacing between rotor and screening plate may be about 1 mm. In the case of paper qualities that are very difficult to pulp, the pulper may include a bedplate mounted around the periphery of the rotor. The spacing between rotor and bedplate may also be about 1 mm.

Pulpers that include screening plates may be constructed as S-type units and may include generally horizontally or vertically aligned rotors.

BACKGROUND OF THE INVENTION

SE-C 189584 (Grubbens & Co) describes a known pulper of the aforesaid kind.

U.S. Pat. No. 4,607,802 (Lamort) describes a similar pulper where the rotor shaft carries helical vanes that extend radially from the attachment part of said shaft.

EP-A2 0117716 (The Black Clawson company) describes a pulper in which the end of the rotor has a conically narrowing part at the attachment part of said rotor.

DE-C 3 149 135 (Sulzer-Escher-Wyss) describes a pulper whose rotor has outwardly projecting arms that move along the screening plate so as to keep the plate clean.

GB-A 2 113 570 (Beloit) describes a pulper whose rotor is provided with detachable defibration plates that move over a screening plate.

OBJECTS OF THE INVENTION

The object of the invention is to provide for use with pulping apparatus a rotor that will function more effectively than those rotors known hitherto and that will pulp effectively paper qualities that are not readily pulped, such as pulp that contains large quantities of recycled paper in high concentrations, and wet-strong paper qualities respectively, and which will generate a larger pulp flow across the screening plate than earlier known rotors.

SUMMARY OF THE INVENTION

These and other objects of the invention are achieved with an inventive pulper of the kind described above and having the characteristic features set forth.

The pressure-generating and subpressure-generating element provided at the end of the rotator located adjacent the screening plate subjects the pulp to an intensive alternating action. The rotor will thereby pulp not-readily pulped paper qualities more quickly than the rotors of hitherto known pulpers. The inventive rotor is thus able to pulp successfully even wet-strong qualities of high concentration. The inventive rotor also enables higher pulp concentrations to pass through the holes in the screening plate and therewith permit a greater flow of pulp to pass across the screening plate than was hitherto considered possible.

The rotor also facilitates a pumping effect, since it normally generates an overpressure on the screening side of the plate.

As a result of the hydrodynamic design of the rotor and the pressure and subpressure generating element, the pulp is subjected to an alternating action as the rotor rotates, with the wing-profile shape of said element counteracting plugging of the holes in the screening plate, since the holes are throughpassed by pulp stock in both directions.

This action will be most pronounced when said element has the form of a radially and outwardly projecting shoulder-like element that has a generally flat leading surface in the direction of rotation of the rotor and that is inclined relative to the screening plate.

The surface will normally be inclined at an angle that varies between 55° and 85°. The best effect is normally obtained with an angle of about 75°.

The leading surface of said element is suitably provided with a hard coating, for instance a coating of stellite.

The pressure-generating and subpressure-generating element may be formed integrally with the rotor, wherewith those parts of the rotor that are particularly subjected to wear are provided with a coating of the aforesaid kind.

According to the invention, should the element become worn, any worn part can be repaired by machining or grinding said part and thereafter fitting a new part, e.g. screwing-on a new part, which will also be conveniently provided with a covering of the aforesaid kind and which, in turn, can be replaced when it becomes worn. This separate part may be both reversible and replaceable in order to enhance its use possibilities.

It also lies within the scope of the invention to provide the pressure-generating and subpressure-generating element with a detachable and replaceable part initially, optionally a reversible wear part of the aforesaid nature.

The inventive rotor may also be adapted to co-act with a bedplate on the screening plate.

Further characteristic features of an inventive pulper and advantages afforded thereby will be evident from the following description of a preferred embodiment of the invention, made with reference to the accompanying drawings.

DETAILED DESCRIPTION OF PREFERRED EMBODIMENTS

Figure 1:
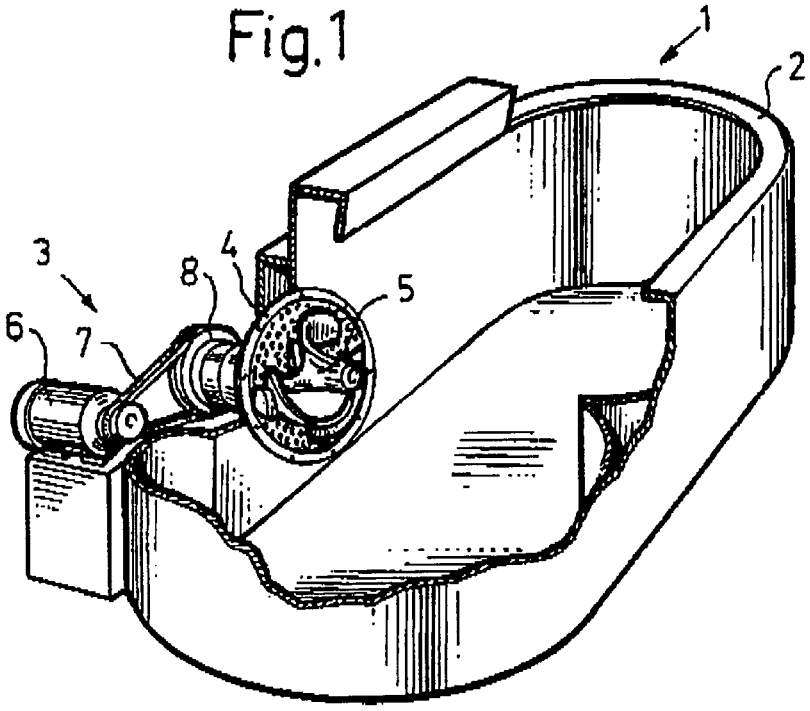
FIG. 1 is a partially cut-away perspective view of a pulper, often designated an "horizontal L-pulper", that includes an S-type rotor fitted adjacent to a screening plate in accordance with the invention.

The pulper illustrated in FIG. 1 is a so-called horizontal L-pulper designed for continuous operation. The pulper tub is identified by the reference numeral 2 and the S-type rotor unit that includes an horizontal rotor shaft is identified by reference numeral 3.

The main parts, of the rotor unit consist of a perforated screening plate 4 and a rotor 5 that has helical vanes. The rotor shaft extends through the screening plate and the diameter of the rotor decreases towards the end of the rotor spaced from said plate. The rotor is driven by a motor 6, via a V-belt and drive pulley 8. Alternatively, a gear box can be used.

The rotor 5 is designed to work at pulp concentrations as high as 16% or more, although it may, of course, also be used successfully at lower pulp concentrations. The rotor is able to rotate at speeds of between 100–700 rpm or higher. Although not shown, the drive motor 6 is suitably thyristor controlled to this end, so as to be able to rotate at optimum speeds in each individual case. The pulper as a whole may operate continuously or batch-wise.

Paper and pulp stock is mainly pulped as a result of the internal friction that is generated in the pulp flow at high concentrations. It is therefore important to obtain effective circulation even at high pulp concentrations.

A pulper unit of S-design implies that the screening plate is mounted adjacent the rotor, with the distance between rotor and screening plate being about 1 mm.

In the case of paper qualities that are very difficult to pulp, the S-unit may be provided with bedplates (not shown) fitted around the periphery of the rotor. The distance between rotor and bedplates may also suitably be about 1 mm. In practice, the number of bedplates used may vary from four to twelve, or more.

Figure 2:
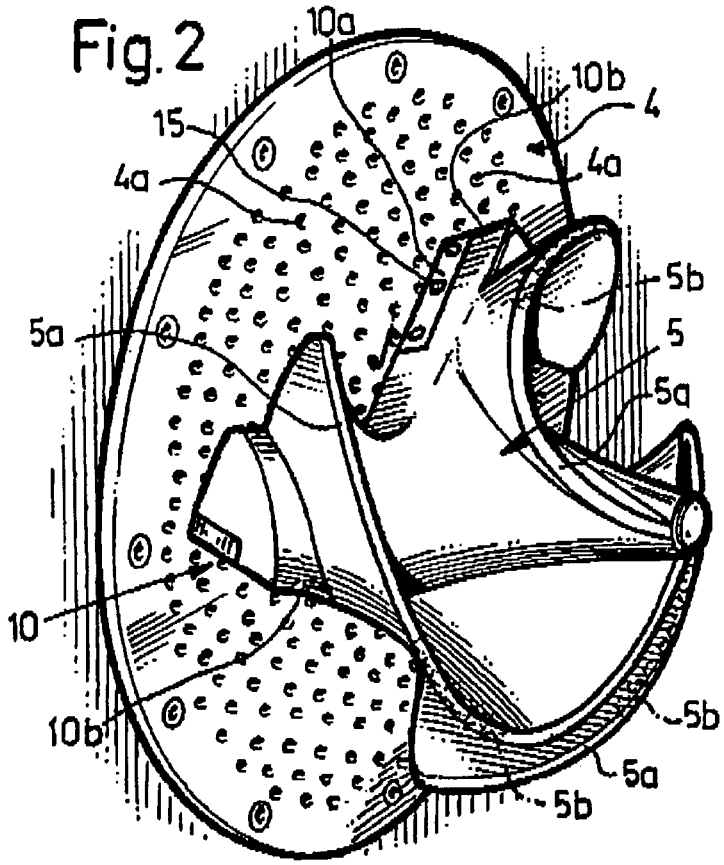
FIG. 2 illustrates in perspective and in larger scale the screening plate and rotor of the pulper shown in FIG. 1.
Figure 3:
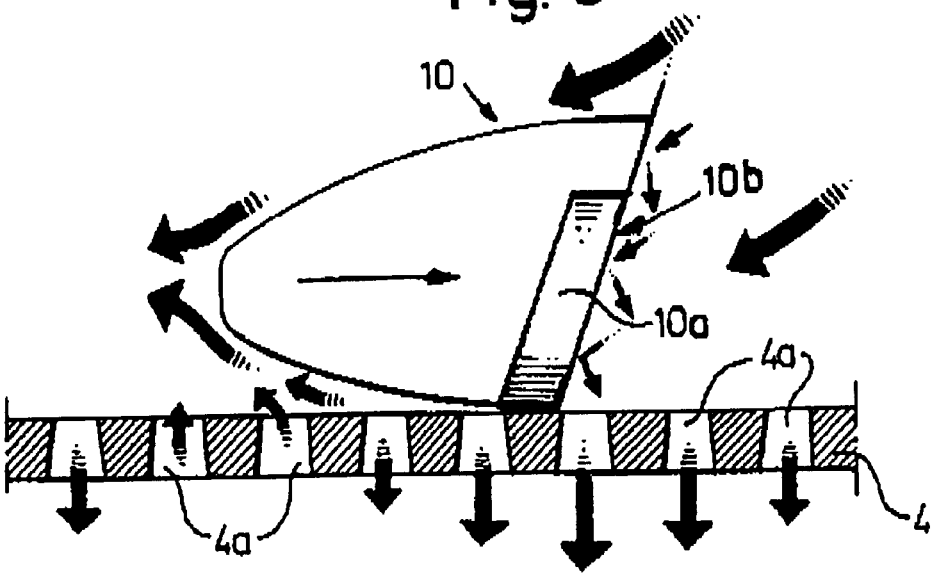
FIG. 3 is a schematic flow diagramme which includes a section taken perpendicularly to the screening plate and which illustrates the winged pressure-generating and subpressure-generating element, and also shows the flow paths generated by said element such as to prevent clogging of the holes in the screening plate.
Figure 4:
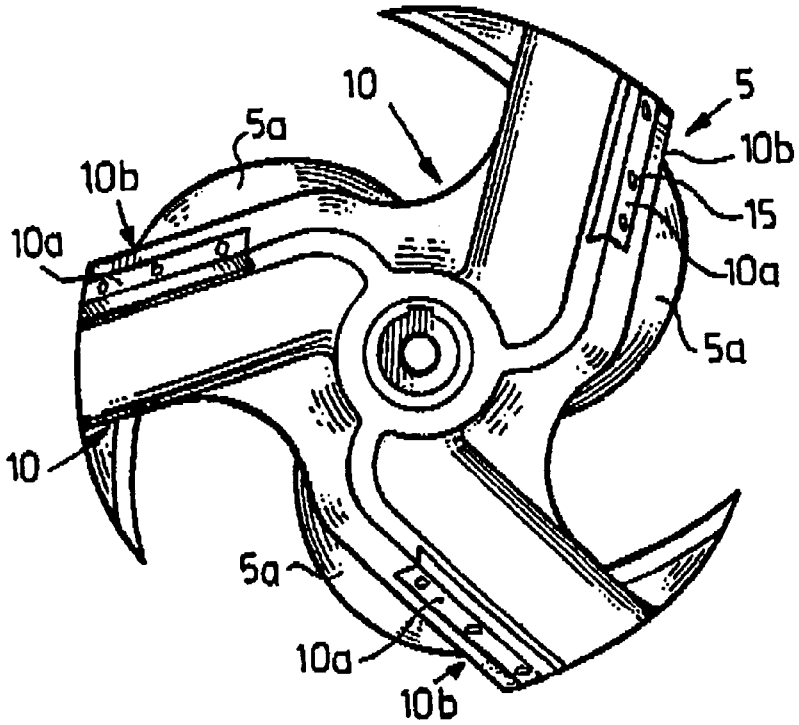
FIG. 4 is an end view of the rotor belonging to the pulper shown in FIGS. 1 and 2.

As will be best seen from FIGS. 2–4, the end of the rotor 5 located in the vicinity of the screening plate carries three radially projecting pressure-generating and subpressure-generating elements, generally referenced 10. These elements 10 are adapted to exert an alternating action on the pulp as the rotor rotates, so as to reduce clogging of the holes 4*a* in the screening plate 4. Naturally, the number of elements 10 carried by the rotor may be other than three.

In the case of the illustrated embodiment, the elements 10 have the form of shoulder-like projections 10 extending radially outwards from the rotor. These shoulders or projections 10 have a generally reversed wing-profiled configuration in the direction of rotation of the rotor with a leading surface 10*b* that functions to press the pulp down towards and against the screening plate (cf FIG. 3), wherewith the pulp slurry is pressed out through the openings in the screening plate. As opposed to the pressure that prevails on the leading edge 10*b,* there is created on the trailing side of said shoulder or element 10 a subpressure which functions to suck the pulp in the opposite direction. This alternating effect contributes towards keeping the holes of the screening plate clean; cf the oppositely directed arrows in FIG. 3.

The leading side 10*b* of respective shoulders or elements 10 is generally planar and is inclined to the screening plate at an angle of about 75°.

The leading surface 10*b* is provided with a covering of hard material, e.g. stellite.

In the illustrated embodiment, the covered or coated surface 10*b* is located on a separate part 10*a* which is detachable in relation to the rotor and which can be replaced and reversed and which is secured to the main part 10 by means of three or four screws 15.

This outer part 10*a* may originally be an integral part of the shoulder-like and reversed wing-like profiled element 10. When this radially outer part becomes worn, it can be ground or machined to a flat state and a new part 10*a* then fitted with the aid of screws 15, for instance. This new part 10*a* may be exchangeable and reversible and provided with a coating or covering 10*b* of the aforesaid kind. This enables the new part 10*a* to be replaced should it become worn.

Some parts of the helical vanes 5*a* of the rotor 5 may be toothed, at 5*b,* for more effective pulping of the pulp stock.

The rotor and screening plate combination according to the present invention can also be used with other types of pulpers, such as with horizontal W-pulpers or a vertical pulper.

The rotor 5 can also be divided such that the pressure-generating and subpressure-generating elements 10 become a separate unit on which the outer end of decreasing diameter, including vanes 5*a,* is attached roughly as a lid.

What is claimed is:

1. A pulper comprising a rotor (5) mounted in a tub (2) adjacent to a perforated screening plate (4) having holes (4*a*), wherein the rotor (5) includes helical vanes; (5*a*) whose diameter decreases towards the outer end of the rotor, characterised by one or more radially and outwardly pressure-generating and subpressure-generating elements (10) joined to the rotor (5) in the region of its end that lies proximal to the screening plate (4), wherein said one or more elements function to subject the pulp to an alternating working action as the rotor rotates, so as to counteract clogging of the holes (4*a*) in the screening plate (4), wherein each of said one or more elements (10) has a leading surface (10*b*), seen in the direction of rotation, that presses the pulp down towards and against the screening plate (4) and therewith force the pulp slurry through the screening holes (4*a*), and a trailing narrowing part that has a generally reversed wing-profile shape, seen in the direction of rotation, such as to generate on the trailing side of said element or elements a subpressure that sucks the pulp in the opposite direction and therewith contributes towards cleaning the holes (4*a*) in the screening plate.

2. A pulper according to claim 1, characterised in that said pressure-generating and subpressure-generating element has the form of a shoulder-like element (10) which projects radially out from a rotor vane and the leading surface (10*b*) is generally flat and inclined in relation to the screening plate (4).

3. A pulper according to claim 2, characterised in that the surface (10*b*) is inclined relative to the screening plate (4) at an angle of between 55° and 85°.

4. A pulper according to claim 3, wherein said angle is about 75°.

5. A pulper according claim 1, wherein said leading surface (10*b*) is provided with a covering or coating of hard material.

6. A pulper according to claim 5, wherein said hard material is stellite.

7. A pulper according to claim 5, characterised in that the coated or covered surface (10*b*) is present on a separate part (10*a*) that is detachable and replaceable relative to the rotor (5).

8. A pulper according to claim 7, wherein said separate part is reversible.

9. A pulper according to claim 1, wherein parts of the rotor vanes (5*a*) are toothed (5*b*).

10. A pulper according to claim 1, wherein the pressure-generating and subpressure-generating element or elements (10) is/are a separate unit onto which the outer end of the rotor (5) of decreasing diameter carrying said vanes (5*a*) can be fitted generally in the form of a lid.

* * * * *